US005329839A

United States Patent [19]

Ehmig

[11] Patent Number: 5,329,839

[45] Date of Patent: Jul. 19, 1994

[54] EXPLOSIVE POWDER CHARGE OPERATED SETTING TOOL

[75] Inventor: Gerhard Ehmig, Rankweil, Austria

[73] Assignee: Hilti Aktiengesellschaft, Fürstentum, Liechtenstein

[21] Appl. No.: 69,472

[22] Filed: Jun. 1, 1993

[30] Foreign Application Priority Data

Jul. 13, 1992 [DE] Fed. Rep. of Germany ..... 4222961

[51] Int. Cl.[5] ..... B25C 1/08; E04G 21/16

[52] U.S. Cl. ..... 89/1.14; 227/10

[58] Field of Search ..... 89/1.14; 227/9, 10; 60/632

[56] References Cited

U.S. PATENT DOCUMENTS 3,319,862 5/1967 Neighorn ..... 227/10
3,481,143 12/1969 Hsu ..... 227/10
3,804,314 4/1974 Gilbert ..... 227/10
4,134,527 1/1979 Termet ..... 227/10
4,364,506 12/1982 Schneider ..... 227/10
5,136,921 8/1992 Büchel ..... 89/1.14

*Primary Examiner*—David H. Brown
*Attorney, Agent, or Firm*—Anderson Kill Olick & Oshinsky

[57] ABSTRACT

An explosive powder charge operated setting tool includes an axially extending driving piston (2) slidably guided in a piston guide (1). The piston guide (1) has a trailing or rear end base part (3) penetrated axially by a through channel (4) which opens in the driving direction of the setting tool into a recess (7) in the base part (3). The trailing end face of the driving piston (2) facing the base part (3) has a centrally arranged annular-shaped depression (10). In axial section the depression (10) is semicircularly-shaped. Depression (10) and recess (7) serve to reverse and direct unburned portions of the explosive powder charge into a hot zone in the base part (3) so that the unburned portions are subsequently ignited and do not foul the setting tool.

9 Claims, 2 Drawing Sheets

EXPLOSIVE POWDER CHARGE OPERATED SETTING TOOL

BACKGROUND OF THE INVENTION

The present invention is directed to an explosive powder charge operated setting tool including a driving piston guided in the piston guide closed at its trailing end by a base part. The base part is penetrated by a centrally arranged channel opening to a powder charge chamber and with the trailing end face of the driving piston facing the base part having a depression.

Explosive charge operated setting tools, where the charge is usually ignited by percussion or a blow and the driving piston is accelerated by the high pressure generated due to the combustion of the powder charge, are especially used where a high volume of fastening elements are driven in a series arrangement. The explosive powder charges can be sleeveless cartridges formed of a powder stamping, or cartridges consisting of a metal housing, a plastic housing or a combination of the two with a conventional explosive powder filling the housing.

A specific power output of the setting tool is required depending upon the particular application. The output depends upon the pressure acting on the driving piston and this pressure is a function of the quantity of the powder used. Further, the pressure depends also on design features of the setting tool parts, such as gas tightness, swept volume, weight relationships and the like.

Experience has shown that the combustion of the explosive powder in the charge occurs extraordinarily quickly at the commencement of ignition. As a result, the portion of the powder located in the immediate vicinity of a detonator, usually located in the base region of the cartridge, is ignited immediately, so that the pressure generated in this region propels the adjoining powder portion in an unignited state. After the explosive powder charges are ignited in the usual manner by a priming arrangement acting upon the detonator from an end facing away from the setting direction, the unignited portion of the powder is propelled in the setting direction, that is, in the direction of the driving piston and the piston guide. Accordingly, the unburned portions of the powder propelled in the setting direction lead to fouling of the tool parts, particularly the piston guide and the driving piston, and result in functional or operating problems.

To eliminate these disadvantages it has been attempted to provide a space for receiving the unburned portion of the powder, so that it cannot penetrate into the guidance gaps between the driving piston and the piston guide and thus foul these parts. The trailing end face of the driving piston is available for forming such a space as disclosed in CH-PS 3 666 007.

In this known apparatus, as it is disclosed in the above-mentioned patent publication, the problems involving the fouling or contamination of the tool parts can be eliminated to a great extent, since the unburned portion of the powder reaches the centrally disposed depression in the end face of the driving piston. This depression has the particular effect that pressure is relieved, so that the unburned portion of the powder enters the guidance gap of the setting tool. This improvement, however, is counterbalanced by another disadvantage, that is, the pressure relief due to the depression results in a loss of output. Such loss of output depends on the volume of the depression, wherein if the depression volume is too small it would be less damaging to the loss of output, this, however, leads to the disadvantage that the pressure relief becomes too small, so that the unburned portion of the powder can penetrate into the guidance gap.

SUMMARY OF THE INVENTION

Therefore, it is the primary object of the present invention to provide an explosive powder charge operated setting tool where fouling of the tool due to an unburned portion of the powder does not occur and, at the same time, high output values are attained.

In accordance with the present invention, the depression in the trailing end of the driving piston is centrally located and annularly-shaped and has an axial cross-section extending radially to the axis of the driving piston open at the trailing end face of the piston and having a semicircularly-shaped configuration. The radially outer diameter of the annular depression corresponds approximately to twice the diameter of the semicircularly-shaped cross-section of the depression. Further, in the base part of the piston guide a central recess is formed open toward the driving piston with the recess having its opening in the front face of the base part greater than the radially outer diameter of the depression in the driving piston.

Due to the inventive features in the driving piston and the base part, the unburned portion of powder is propelled into the depression in the driving piston. Due to the shape of the depression, the unburned portion of the powder is projected radially outwardly from the center into a cooler zone of the driving piston and then is reversed due to the semicircularly-shaped configuration of the depression so that the unburned portion arrives in the recess of the base part. In the recess in the base part, the unburned portion is directed into a hot zone towards the through channel where it is burned. Thus the invention provides two effects, on one hand, a space is provided for the unburned portion of the powder which prevents it from reaching the guidance gaps. On the other hand, the space, that is the depression in the driving piston, is shaped so that the unburned portion of the powder is redirected into the hot zone where it is burned affording additional pressure build-up and increasing the output of the charge and, at the same time, avoiding a fouling of the tool.

To assure an unimpeded flow of the unburned portions of the powder, redirected in the depression, into the recess in the base part, the diameter of the recess is slightly larger than the radially outer diameter of the depression. An exposed annular shoulder is formed in the trailing end face of the driving piston encircling the depression with the shoulder facing the radially outer part of the recess.

Good results are obtained with preferred dimensioning of the depression, where advantageously its depth measured in the axial direction of the driving piston amounts to 0.05 to 0.2 times and its radially outer diameter amounts to 0.2 to 0.8 times the diameter of the guidance region of the driving piston surrounding the depression. As far as the reversing or redirecting characteristics are concerned, a radius of the depression has been shown to give particularly good results in actual practice and advantageously amounts to 0.05 to 0.20 times the diameter of the guidance region of the driving piston surrounding the depression.

The diameter difference forming the above-mentioned shoulder for the uninterrupted flow from the depression in the driving piston into the recess in the base part, the diameter relationship can be shown to be particularly effective where advantageously the diameter of the opening from the recess amounts to 1.05 to 1.15 times the radially outer diameter of the depression in the driving piston.

The volumes of the depression in the driving piston and of the recess in the base part can be approximately equal. As a result, the depth of the recess in the base part measured in the axial direction of the driving piston amounts usefully to 0.05 to 0.2 times the diameter of the guidance region of the driving piston surrounding the depression. To assure that the unburned portion of the powder redirected from the depression in the driving piston into the recess in the base part can be guided without interference into the hot zone in the base part channel, the transition from the opening to the base of the recess is shaped in a concave manner and is particularly useful with a radius corresponding essentially to the radius in the depression. Therefore, no interference occurs resulting from the redirection of the unburned portion of the powder moving along the circular path.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
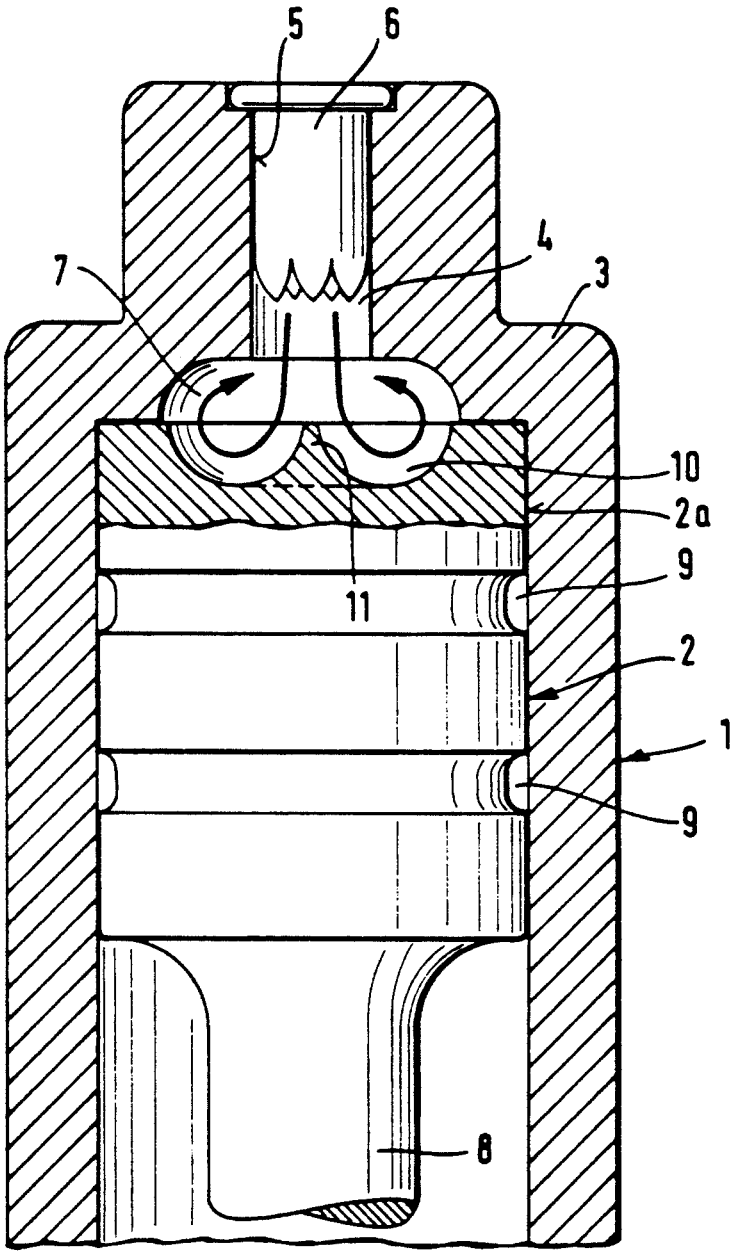
FIG. 1 is an axially extending sectional view of the rear part of a piston guide and a driving piston in an explosive powder charge operated setting tool.

The rear or trailing end region of a piston guide 1, shown in FIG. 1, is part of a known explosive powder charge operated setting tool, not shown. An axially elongated driving piston 2 slides inside the piston guide 1 and only the trailing end region of the piston is shown. The piston guide 1 and driving piston 2 are coaxially arranged. As viewed in FIG. 1, the setting tool has a driving direction in the downward direction.

Piston guide 1 has a base part 3 closing its trailing end. Base part 3 has a through channel 4 opening rearwardly into an explosive powder charge chamber 5. An unignited cartridge 6 is fitted in the cartridge chamber 5, as shown in FIG. 1. In the driving direction relative to the cartridge chamber 5 the through channel 4 opens into a central recess 7 open at the front end of the base part 3, that is, the end facing towards the trailing end of the driving piston 2. In the front end of the base part 3, the recess 7 has a diameter considerably larger than the diameter of the through channel 4.

Figure 2:
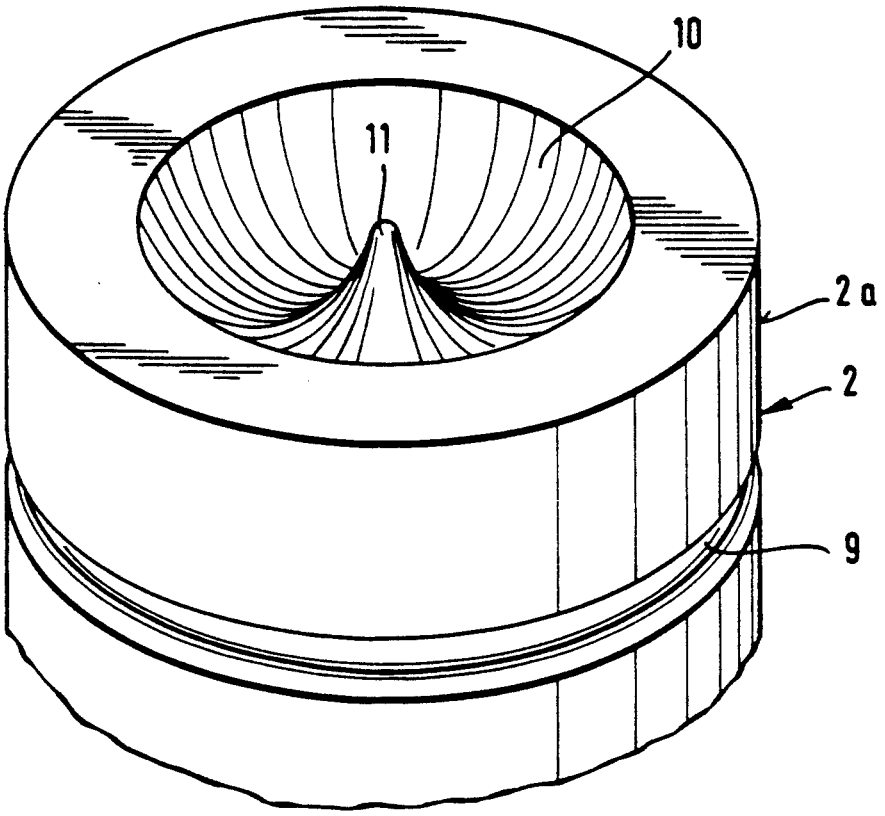
FIG. 2 is a perspective view of the trailing end face of the driving piston in FIG. 1.

In the driving direction the driving piston 2 has a known shaft 8. Shaft 8 has a smaller diameter than the trailing end of the driving piston. The driving piston 2 has a guidance region 2*a* between the shaft 8 and the trailing end face of the driving piston. The guidance region 2*a* has a diameter and is provided in a known manner with circumferentially extending grooves 9, which serve for sealing purposes and also for receiving sealing rings, not shown. The trailing end face of the driving piston 2 has an annular-shaped depression 10, as shown in FIG. 2. Depression 10 viewed in section in FIG. 1 is essentially semicircularly-shaped in cross-section viewed in the axial direction of the driving piston 2. An island or lug 11 is located in the center of the depression 10 with the trailing end surface of the lug flush with the trailing end face of the driving piston 2. The semicircularly-shaped surface of the depression 10 has a radius with a center point located flush with the trailing end face of the driving piston 2.

The diameter of the recess 7 in the front end face of the base part 3 is larger than the radially outer diameter of the depression 10 in the driving piston as can be noted in FIG. 1. Due to the diameter difference between the recess 7 and depression 10, there is no shoulder formed at the transition between the driving piston 2 and the end part 3 which interferes with the redirected flow of the unburned portion of the powder of the cartridge 6, the flow of the unburned portion is indicated by the arrows.

A conventional explosive powder charge provided with a metal jacket is shown as the cartridge 6 in the embodiment shown in FIG. 1. The present invention, however, is not limited to such an explosive powder charge. The problems to which the present invention are directed can be solved with all types of powder charges whether they are enclosed in a metal or plastics housing or whether sleeveless or housing-free pressed charges are used. Accordingly, the inventive concept can be applied to all types of explosive powder charge operated setting tools.

While a specific embodiment of the invention has been shown and described in detail to illustrate the inventive principles, it will be understood that the invention may be embodied otherwise without departing from said principles.

I claim:

1. Explosive powder charge operated setting tool comprising an axially extending piston guide (1) having a trailing end and extending axially in a driving direction of the tool, an axially elongated driving piston (2) coaxially with and slidably mounted and guided within said piston guide and having a trailing end relative to the driving direction of the tool, said piston guide (1) is closed at the trailing end thereof by a base part (3), said base part has an axially extending channel open opposite to the driving direction to an explosive powder charge chamber (5), said driving piston (2) has a depression in the trailing end thereof facing said base part (3), wherein the improvement comprises that said depression (10) is annularly-shaped and extends concentrically about the axis of said driving piston (2) and is semicircularly-shaped in axial cross-section, said depression has a radially outer diameter corresponding approximately to twice the diameter of the semicircular cross-section at the trailing end of said driving piston, and said base part has a front end surface facing the trailing end of said drive piston with a recess (7) arranged centrally of the axis of said piston guide (1) and having a diameter greater than the radially outer diameter of said depression (10) in said driving piston (2).

2. Explosive powder charge operated setting tool, as set forth in claim 1, wherein said annular-shaped depression (10) encircles a lug (11) with the lug having a trailing end surface flush with the trailing end surface of said driving piston (2).

3. Explosive powder charge operated setting tool, as set forth in claim 1, wherein said driving piston (2) extending from the trailing end thereof has a guidance region (2a) forming a guidance surface having a diameter in contact with said piston guide (1), said depression (10) has a maximum depth extending in the axial direction of the driving piston (2) in the range of 0.05 to 0.2 times the diameter of said guidance surface (2a) of said driving piston (2).

4. Explosive powder charge operated setting tool, as set forth in claim 1 or 3, wherein the radially outer diameter of said depression (10) in the trailing end face of said driving piston (2) is in the range of 0.2 to 0.8 times the diameter of said guidance surface (2a) of said driving piston (2) .

5. Explosive powder charge operated setting tool, as set forth in claim 4, wherein the semicircularly-shaped cross-section of said depression (10) has a radius with a center point coinciding with the trailing end face of said driving piston (2).

6. Explosive powder charge operated setting tool, as set forth in claim 5, wherein the diameter of said recess (7) in the front end surface of said base part (3) is in the range of 1.05 to 1.15 times the radially outer diameter of said depression (10).

7. Explosive powder charge operated setting tool, as set forth in claim 6, wherein the maximum depth of said recess (7) measured in the axial direction of said piston guide (1) is in the range of 0.05 to 0.2 times the diameter of said guidance surface (2a) of said driving piston (2).

8. Explosive powder charge operated setting tool, as set forth in claim 7, wherein said recess (7) has a transition surface extending from the front end surface of said base part (3) to a base thereof and said transition surface having a concave curvature.

9. Explosive powder charge operated setting tool, as set forth in claim 8, wherein the concave curvature of said transition surface has a radius corresponding approximately to the radius of the semicircularly-shaped axial section of said depression (10).

* * * * *